US006439303B1

(12) United States Patent
Sorhus et al.

(10) Patent No.: US 6,439,303 B1
(45) Date of Patent: Aug. 27, 2002

(54) DOWNHOLE MAGNETIC RETRIEVAL APPARATUS

(75) Inventors: Atle Johnny Sorhus, Hinna (NO); Larry Thomas Palmer, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/613,178

(22) Filed: Jul. 10, 2000

(51) Int. Cl.[7] ..... E21B 31/08
(52) U.S. Cl. ..... 166/99; 166/311; 166/66.5
(58) Field of Search ..... 166/66.5, 311, 166/99, 171, 173, 301; 220/288

(56) References Cited

U.S. PATENT DOCUMENTS

| | | | | |
|---|---|---|---|---|
| 2,830,663 A | * | 4/1958 | Kirby, II | |
| 2,834,630 A | * | 5/1958 | Greer | |
| 2,857,970 A | * | 10/1958 | Hopkins | |
| 3,417,822 A | * | 12/1968 | Howell | |
| 3,637,033 A | * | 1/1972 | Mayall | |
| 4,059,155 A | * | 11/1977 | Greer | |
| 4,084,636 A | * | 4/1978 | Burge | |
| 4,620,641 A | * | 11/1986 | Beer | |
| 5,453,188 A | * | 9/1995 | Florescu et al. | |
| 5,461,746 A | * | 10/1995 | Banik et al. | 15/104.061 |
| 5,580,114 A | * | 12/1996 | Palmer | |
| 5,666,050 A | * | 9/1997 | Boudin et al. | |
| 5,699,577 A | * | 12/1997 | Rankin | 15/104.061 |
| 6,170,577 B1 | * | 1/2001 | Noles, Jr. et al. | |
| 6,176,311 B1 | * | 1/2001 | Ryan | |
| 6,216,787 B1 | * | 4/2001 | Ruttley | 166/311 |

FOREIGN PATENT DOCUMENTS

| | | | | |
|---|---|---|---|---|
| GB | WO 92/19838 | * | 11/1992 | E21B/31/02 |
| GB | 2 350 632 A | | 12/2000 | |

OTHER PUBLICATIONS

Bowen Instruction Manual; *Bowen Fishing Magnets*; p. 1. (Best available copy.) undated.

Bakers Oil Tools Product Catalog; Fishing Services; p. 95. (Best available copy.) undated.

Bakers Oil Tools Product Specification Sheet; 3–1/2" O.D. Chip Catcher; 1 page. (Best Available Copy.) undated.

Baker Oil Tools Norway Tool Sketch; 8" Magnet Sub; 1 page; (Best Available Copy.) undated.

Composite Catalogue of Oil Field Equipment & Services, 44th Edition, available at www.worldoil.com/CCatalogue; copies provided for "Magnets–Fishing" search results, 1 pg, & brochures from IE, 2 pgs, PCC Sterom, SA, 2 pgs, Gotco International, 2 pgs.*

Baker Fishing Services and Tool Catalogue, pp. 2–114.*

* cited by examiner

*Primary Examiner*—David Bagnell
*Assistant Examiner*—Katherine Mitchell
(74) *Attorney, Agent, or Firm*—Gerald W. Spinks

(57) ABSTRACT

A tool for removal of magnetic debris from a well bore, having a plurality of magnets retained in a plurality of recesses by a plurality of retainer caps which are threadable into the recesses. The retainer caps can be made of non-magnetic material, and non-magnetic spacers can be used, to isolate the magnets from the tool body and the surroundings. The retainer caps can be positioned entirely within the recesses, to streamline the tool body. The magnets can be removed from the recesses and replaced.

17 Claims, 2 Drawing Sheets

DOWNHOLE MAGNETIC RETRIEVAL APPARATUS

CROSS REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

This invention is in the field of apparatus used to remove debris from a well bore. Specifically, this invention applies magnetic force to attract magnetic debris to the tool, after which the tool can be withdrawn from the well bore to remove the debris.

2. Background Art

In the process of drilling an oil or gas well, producing oil or gas from the well, or refurbishing an existing well, tool failures and normal operation often result in the depositing in the well bore of various kinds of debris. Downhole milling of metal items produces metallic mill cuttings which often are not completely removed from the well bore by circulation of milling fluid. Furthermore, bit cones, bearings, slips, tong pins, and hammers, or fragments thereof, can collect at the bottom of the well bore. Several devices have been developed for the removal of such debris from the well bore.

Tools incorporating a basket often circulate fluid up the annulus at a rapid rate, to carry the debris upwardly to an area of reduced flow rate where the debris falls back, to settle into a basket for retrieval. Other basket tools use a venturi effect to draw debris into the tool, usually at the bottom end, then it is caught in a basket within the tool. Debris which is magnetic, or susceptible to magnetic attraction, can be attracted to a tool which incorporates magnets, followed by removal of the tool and its attached debris from the well bore. Some such tools have a magnet in the lower end of the tool, for the purpose of attaching magnetic debris to the lower end of the tool.

Another tool has been devised which has a plurality of magnets aligned in a string in a cavity near the outer surface of the tool, covered by a thin metal housing. Yet another tool has been devised which has a plurality of magnets individually embedded into a plurality of recesses in the outer surface of the tool, around its periphery. In this type of tool, nonmagnetic cups may be pressed or brazed into the recesses, and a set pattern of magnets are essentially permanently retained in the nonmagnetic cups by means of epoxy, or some other adhesive. The magnets are typically exposed to the well bore environment surrounding this tool, subjecting them to physical damage or corrosion in the well bore. Further, the exposed magnets are subject to physical damage during the process of cleaning debris from the tool after it is withdrawn from the well bore. Still further, the exposed magnets may even be lost in the well bore when the retaining epoxy becomes soft because of high well bore temperature.

It would be desirable to have a magnetic debris retrieval tool in which magnets could be placed in a choice of patterns on the outer perimeter of the tool and easily removed therefrom. It would also be desirable to cover the magnets with protective covers, and to magnetically isolate the magnets from the remainder of the tool to enhance their performance.

BRIEF SUMMARY OF THE INVENTION

By way of example, the preferred embodiment of the present invention is a tool for removal of magnetically susceptible debris from a well bore, by causing the debris to adhere to the body of the tool and removing the tool from the well bore. The tool body has a plurality of recesses in its outer surface. A plurality of magnets can be inserted in selected recesses to form a desired pattern of magnets. The magnets are retained in the recesses by retainer caps which thread into the recesses. The retainer caps are designed to fit entirely within the recesses, to give the tool a streamlined aspect, or an unobstructed outer surface. The retainer caps may be small enough to fit entirely within the recesses, threaded therein by the use of some low profile drive contour, such as a hexagonal head, a recessed hexagonal shape, or a screwdriver slot. Alternatively, the retainer cap may be threaded into the recess by the use of a drive member which can subsequently be removed from the retainer cap, by the application of higher torque to shear the drive member away, or by some similar operation. The retainer caps can be constructed of a non-magnetic material, and non-magnetic spacers can be placed beneath the magnets, to isolate the magnets from the tool body, thereby enhancing the performance of the magnets.

The novel features of this invention, as well as the invention itself, will be best understood from the attached drawings, taken along with the following description, in which similar reference characters refer to similar parts, and in which:

DETAILED DESCRIPTION OF THE INVENTION

Figure 1:
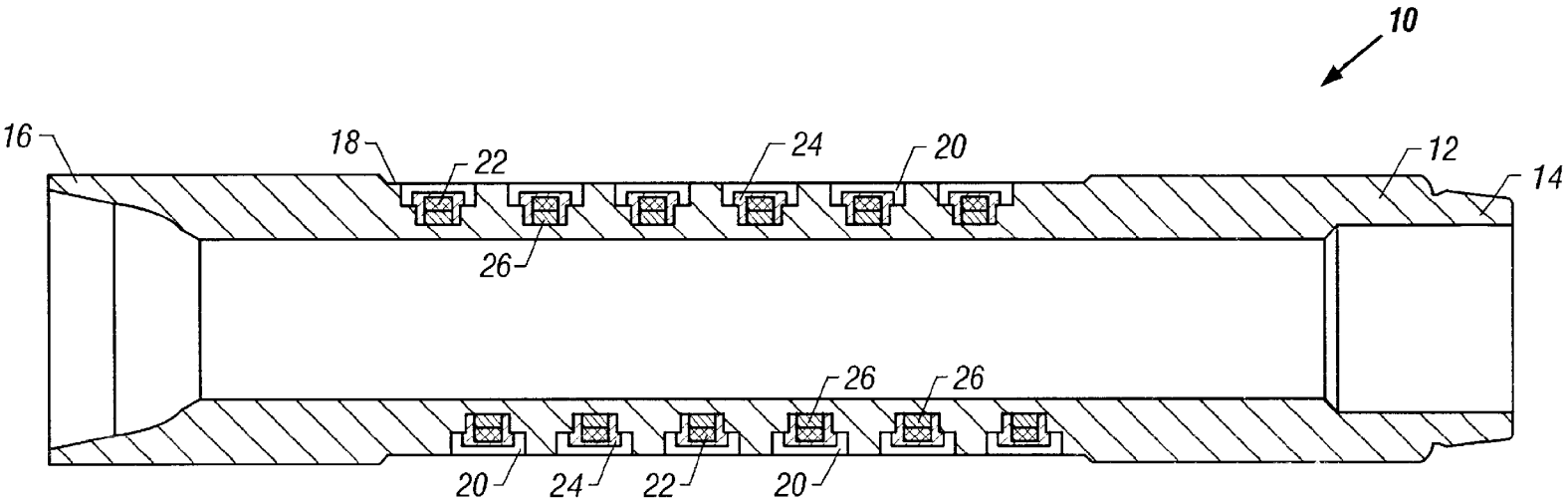
FIG. 1 is a longitudinal section of a tool according to the present invention, showing one arrangement of some of the recesses, magnets, and retainer caps.

As shown in FIG. 1, the retrieval tool 10 of the present invention has an elongated, generally cylindrical, tool body 12. The tool body 12 has an upper end 14 adapted to be threadedly attached to a work string (not shown) for lowering into a well bore. The tool body 12 also has a lower end 16 adapted to be threadedly attached to a downhole tool (not shown), such as a drill bit or downhole motor. Several of the retrieval tools 10 could also be attached in tandem to a work string, and they could be attached at an intermediate location in the work string.

The tool body 12 has a generally cylindrical outer surface 18, which can have several different diameters. Positioned on the tool outer surface 18 are a plurality of recesses 20 into the tool body 12. Each of the recesses 20 can have installed therein a magnet 22, a retainer cap 24, and a spacer 26. Typically the magnet 22 is a permanent magnet, although an electromagnet would be within the scope of the invention. The spacer 26 can be constructed of a non-magnetic material, such as stainless steel. The retainer cap 24 is threaded into the recess 20 over the spacer 26 and the magnet 22, in such a way as to retain the magnet 22 and the spacer 26 in place in the recess 20. It can be seen that, after installation, the retainer cap 24 and all the elements thereunder are configured to fit entirely within the recess 20. Different types of retainer caps and spacers can be used to accomplish this objective, as will be discussed later. The pattern in which the recesses 20 are formed in the outer surface 18 of the tool body 12 can vary as desired for a particular application. Further, magnets 22 can be inserted into selected recesses 20 as desired, to form a preferred pattern of magnets 22 for a given application.

Figure 2:
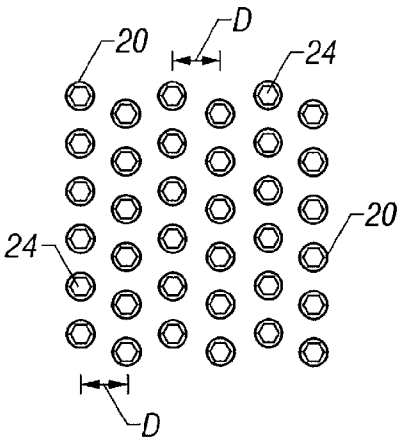
FIG. 2 is an elevation view of one embodiment of a pattern of recesses that may be used in the present invention.

FIG. 2 shows a sample pattern of recesses 20 and retainer caps 24 that might be used on a tool body 12. If desired, some of the recesses 20 could be left empty, or they could have retainer caps 24 installed, with no magnets 22. FIG. 2 is a flat representation of a pattern that might be wrapped around the cylindrical outer surface 18 of the tool body 12. As shown, adjacent rows of recesses 20 can be offset from each other. Alternatively, they could be aligned with each other, or some other pattern could be used. The angular spacing D between adjacent rows could be designed to cause the pattern to wrap entirely around the cylindrical surface 18 of the tool body 12. For instance, in the embodiment shown, with six rows of recesses 20, placing the rows with an angular spacing D of 60° would result in the pattern wrapping entirely around the surface 18. Other angular spacing D could also be used, and the pattern could be placed on a selected portion of the outer surface 18.

Figure 3:
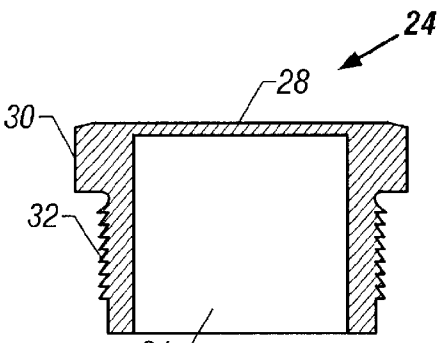
FIG. 3 is a section view of a hexagonal head retainer cap that may be used in the present invention.

FIG. 3 is a section view of one type of retainer cap 24 that might be used in the present invention. The embodiment shown here has a thin upper bulkhead 28, thereby minimizing the spatial separation between the magnet 22 and the surrounding environment. The retainer cap 24 can be constructed of a non-magnetic material, such as stainless steel. The upper shoulder of the retainer cap 24 has an external hexagonal drive contour 30, facilitating the threading of the retainer cap 24 into a recess 20 with a wrench or similar tool. Other low profile drive contours could also be used instead of the external hexagonal drive contour, such as a hexagonal recess, or a screw driver slot. An external thread 32 is provided on the periphery of the retainer cap 24, to facilitate the threading of the retainer cap 24 into a recess 20. An internal cavity 34 is provided within the retainer cap 24, to provide room for a magnet 22, and if desired, a spacer 26.

Figure 4:
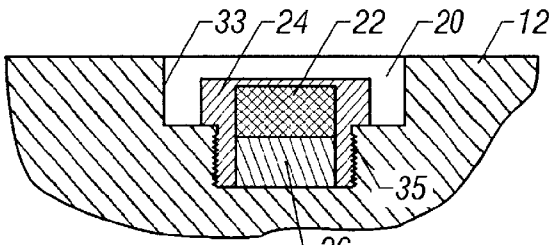
FIG. 4 is a partial section view of a recess, magnet, hexagonal head retainer cap, and spacer, according to the present invention.

FIG. 4 is a section view of one recess 20, with a magnet 22, a spacer 26, and a low profile retainer cap 24 installed therein. It can be seen that the retainer cap 24, when installed, fits entirely within the recess 20, leaving the tool body 12 with a streamlined or unobstructed outer profile. The recess 20 has an enlarged diameter unthreaded portion 33 to accommodate the drive contour 30 of the hexagonal drive retainer cap 24. The retainer cap 24 is the sole means of retaining the magnet 22 and the spacer 26 within the recess 20, by being threaded into internal threads 35 within the recess 20. This facilitates the removal and relocation or replacement of the magnet 22 and the spacer 26. In this embodiment, the magnet 22 and the spacer 26 fit entirely within the cavity 34 within the retainer cap 24. The spacer 26 can be constructed of a non-magnetic material, such as stainless steel. When a non-magnetic retainer cap 24 and a non-magnetic spacer 26 are used, the magnet 22 is isolated from the remainder of the tool 10, and the magnetic performance of the magnet 22 is enhanced.

Figure 5:
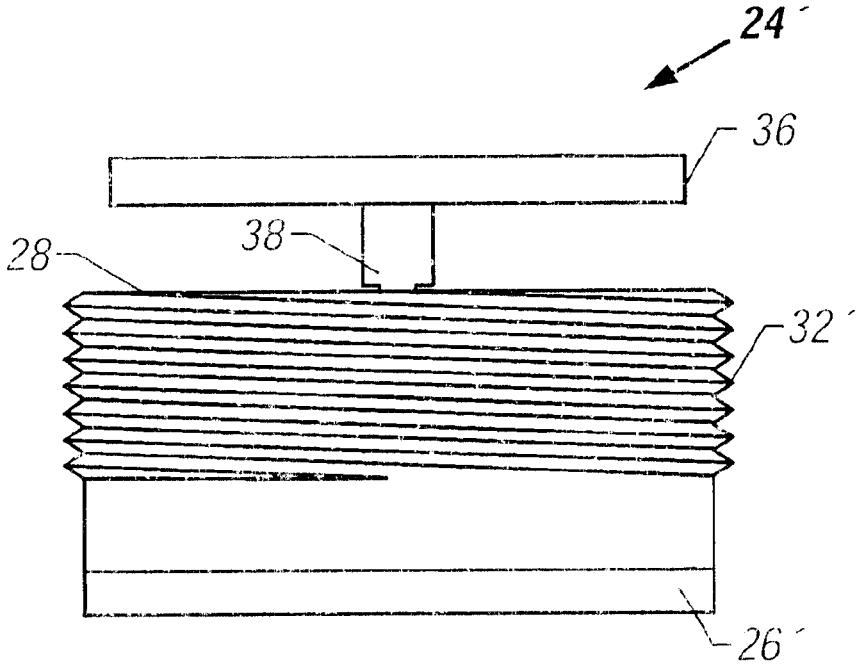
FIG. 5 is an elevation view of a retainer cap with a shearable drive member, that may be used in the present invention.

FIG. 5 shows another type of retainer cap 24' and spacer 26' which can be used. This embodiment of the retainer cap 24' has an external thread 32', similar to the first embodiment, except that the external thread 32' in this embodiment runs all the way up to the upper bulkhead 28 of the retainer cap 24'. The drive contour, furthermore, is different in this embodiment. That is, this embodiment of the retainer cap 24' has a removable drive member 36. This particular removable drive member 36 is a circular disc, which is attached to the upper bulkhead 28 of the retainer cap 24' by means of a drive shaft 38. The drive shaft 38 has a small cross-section, making the drive member 36 shearable from the retainer cap 24'. Other types of removable drive members could also be used, such as a shearable drive bar or a shearable hexagonal head. The spacer 26' shown with this embodiment of the retainer cap 24' is a disc which fits under the lower end of the retainer cap 24', rather than within the inner cavity. This leaves the entire inner cavity available for installation of a magnet 22.

Figure 6:
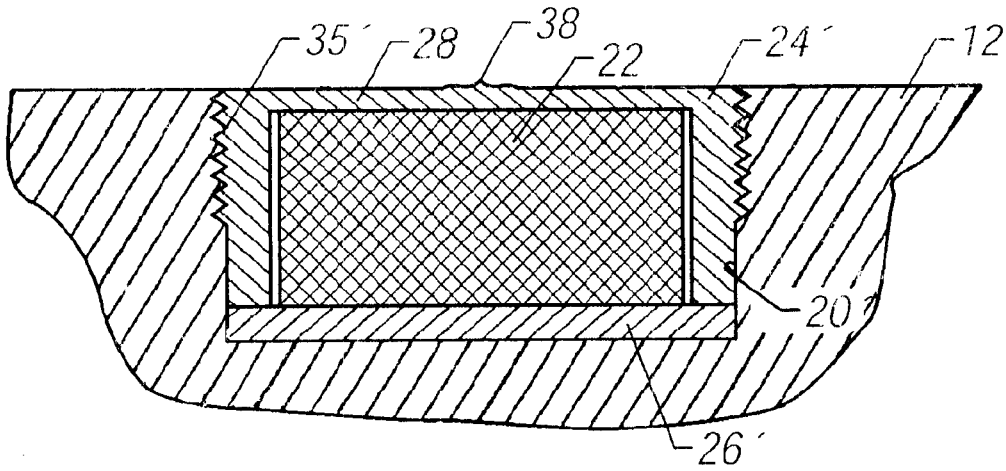
FIG. 6 is a partial section view of a recess, magnet, shearable drive retainer cap, and spacer, according to the present invention.

FIG. 6 shows the second embodiment of the retainer cap 24' installed within a recess 20'. This embodiment of the recess 20' has threads 35' up to the outer surface 18 of the tool body 12, rather than having an enlarged diameter unthreaded portion like the first embodiment of the recess 20. The spacer 26' can be inserted first into the recess 20', and the magnet 22 can be placed into the retainer cap 24'. Then, the retainer cap 24' is threaded into the recess 20', by means of the drive member 36. Excess torque can then be applied to the drive member 36 to shear the drive shaft 38 from the upper bulkhead 28 of the retainer cap 24', thereby removing the drive member 36 from the retainer cap 24'. Preferably, the drive shaft 38 is designed to shear near the upper bulkhead 28 of the retainer cap 24', to leave the tool body 12 with a streamlined or unobstructed outer profile. One or more recessed drive countours (not shown) can be provided in the upper bulkhead 28 of the retainer cap 24', to facilitate the removal of the retainer cap 24' from the recess, if desired. Here again, the retainer cap 24' and the spacer 26' can be constructed of a non-magnetic material, such as stainless steel. When a non-magnetic retainer cap 24' and a non-magnetic spacer 26' are used, the magnet 22 is isolated from the remainder of the tool 10, and the magnetic performance of the magnet 22 is enhanced.

While the particular invention as herein shown and disclosed in detail is fully capable of obtaining the objects and providing the advantages hereinbefore stated, it is to be understood that this disclosure is merely illustrative of the presently preferred embodiments of the invention and that no limitations are intended other than as described in the appended claims.

We claim:

1. An apparatus for retrieval of downhole debris, comprising:

a tool body adapted for attachment to a work string;

a plurality of recesses formed in an outer surface of said tool body;

a plurality of magnets, each said magnet being positionable in one of said plurality of recesses; and a plurality of retainer caps, each said retainer cap being mountable in one of said plurality of recesses, each said retainer cap being configured to retain one of said plurality of magnets in one of said plurality of recesses.

2. The apparatus recited in claim 1, wherein each said retainer cap is threadable into one of said plurality of recesses.

3. The apparatus recited in claim 1, wherein each said magnet is retained within one of said plurality of recesses solely by one of said plurality of retainer caps.

4. The apparatus recited in claim 1, wherein:

a plurality of said recesses are formed in a lateral outer surface of said tool body; and each said retainer cap is adapted to be fit entirely within one of said plurality of recesses in said lateral outer surface.

5. The apparatus recited in claim 4, wherein each said retainer cap is originally configured to fit entirely within one of said plurality of recesses in said lateral outer surface.

6. The apparatus recited in claim 1, wherein each said retainer cap is constructed of non-magnetic material.

7. A The apparatus recited in claim 1, wherein:

said tool body comprises a substantially cylindrical body; and said plurality of recesses are formed in the substantially cylindrical outer surface of said tool body.

8. The apparatus recited in claim 7, wherein said substantially cylindrical tool body comprises an upper end adapted for connection to a work string and a lower end adapted for connection to a downhole tool.

9. An apparatus for retrieval of downhole debris, comprising:

a tool body adapted for attachment to a work string;

a plurality of recesses formed in an outer surface of said tool body;

a plurality of magnets, each said magnet being positionable in one of said plurality of recesses;

a plurality of retainer caps, each said retainer cap being mountable in one of said plurality of recesses, each said retainer cap being configured to retain one of said plurality of magnets in one of said plurality of recesses; and a removable drive member on each said retainer cap, said retainer cap being configured to fit entirely within one of said plurality of recesses in said lateral outer surface, after removal of said drive member;

wherein:

a plurality of said recesses are formed in a lateral outer surface of said tool body; and each said retainer cap is entirely contained within one of said plurality of recesses in said lateral outer surface.

10. The apparatus recited in claim 9, wherein said removable drive member comprises a shearable drive member.

11. An apparatus for retrieval of downhole debris, comprising:

a tool body adapted for attachment to a work string;

a plurality of recesses formed in an outer surface of said tool body;

a plurality of magnets, each said magnet being positionable in one of said plurality of recesses;

a plurality of retainer caps, each said retainer cap being mountable in one of said plurality of recesses, each said retainer cap being configured to retain one of said plurality of magnets in one of said plurality of recesses; and a plurality of non-magnetic spacers, each said non-magnetic spacer being positionable under one of said plurality of magnets in one of said plurality of recesses.

12. An apparatus for retrieval of downhole debris, comprising:

a tool body adapted for attachment to a work string;

a plurality of recesses in a lateral outside surface of said tool body;

a plurality of magnets, each said magnet being positionable in one of said plurality of recesses;

a plurality of non-magnetic spacers, each said non-magnetic spacer being positionable under one of said plurality of magnets in one of said plurality of recesses; and a plurality of non-magnetic retainer caps, each said retainer cap being threadable into one of said plurality of recesses, each said retainer cap being configured to retain one of said plurality of magnets in one of said plurality of recesses;

wherein each said retainer cap is adapted to be entirely contained within one of said plurality of recesses.

13. The apparatus recited in claim 12, wherein each said magnet is retained within one of said plurality of recesses solely by one of said plurality of retainer caps.

14. The apparatus recited in claim 12, wherein each said retainer cap is originally configured to fit entirely within one of said plurality of recesses.

15. The apparatus recited in claim 14, wherein each said retainer cap includes a hex shaped drive contour.

16. The apparatus recited in claim 12, further comprising a removable drive member on each said retainer cap, said retainer cap being configured to fit entirely within one of said plurality of recesses after removal of said drive member.

17. The apparatus recited in claim 16, wherein said removable drive member comprises a shearable drive member.

* * * * *